US005398830A

United States Patent [19]

de Pous et al.

[11] Patent Number: 5,398,830

[45] Date of Patent: Mar. 21, 1995

[54] UNREPLACEABLE RECEPTACLE CLOSURE SYSTEM

[75] Inventors: Olivier de Pous, Neuilly-sur-Seine; Claude Jouillat, Montigny-sur-Avre, both of France

[73] Assignee: Etablissements Valois (Societe anonyme), Le Neubourg, France

[21] Appl. No.: 191,102

[22] Filed: Feb. 3, 1994

[30] Foreign Application Priority Data

Feb. 4, 1993 [FR] France ..... 93 01238

[51] Int. Cl.[6] ..... B65D 41/04

[52] U.S. Cl. ..... 215/324; 215/31; 215/329

[58] Field of Search ..... 215/1 R, 31, 200, 263, 215/318, 324, 329, 330, 331; 220/200, 288, 289, 298, 301, 309, 310, 890

[56] References Cited

U.S. PATENT DOCUMENTS

| | | | |
|---|---|---|---|
| 2,193,227 | 3/1940 | Deletzke | 215/324 X |
| 2,304,826 | 12/1942 | Jackson | 215/324 |
| 4,717,034 | 1/1988 | Mumford | 215/318 |

*Primary Examiner*—Allan N. Shoap
*Assistant Examiner*—Nova Stucker
*Attorney, Agent, or Firm*—Sughrue, Mion, Zinn, Macpeak and Seas

[57] ABSTRACT

A closure system for a receptacle having a neck in which an opening is formed and provided with outwardly projecting external threads each extending between a first end further from the opening and a second end closer to the opening, the system comprising a cap having a side wall that surrounds the neck and that fits substantially snugly over the shape of the external threads thereof. The cap is made of a material that is elastically deformable, and at least some of the threads of the neck are spaced apart in pairs by a circumferential distance around the neck that decreases progressively between the first and second ends of the threads.

7 Claims, 1 Drawing Sheet

FIG.1
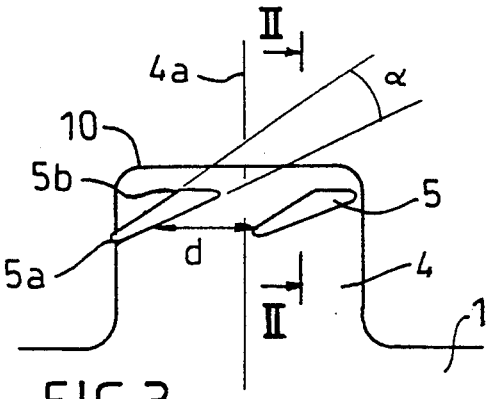
FIG.2
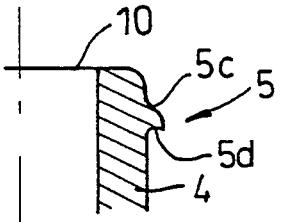
FIG.3
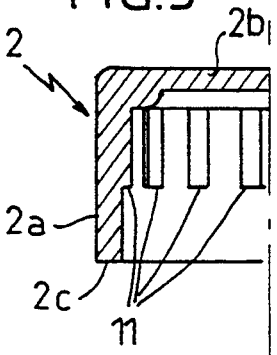
FIG.7
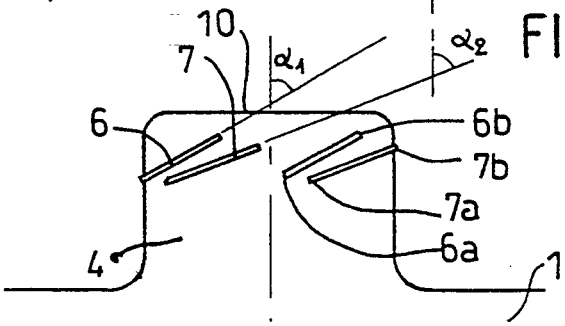
FIG.4
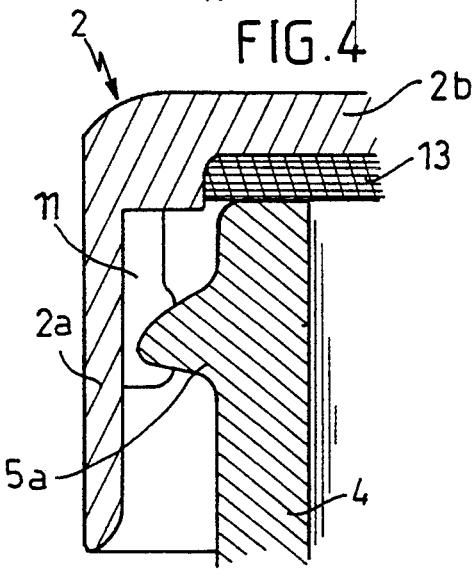
FIG.5
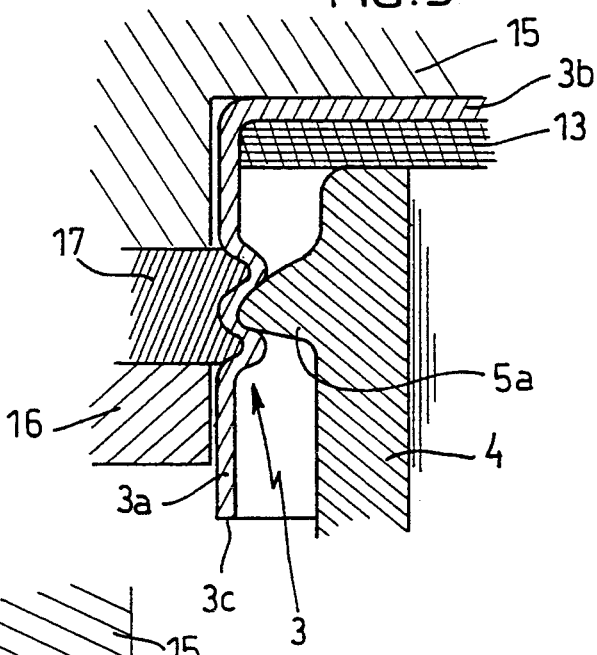
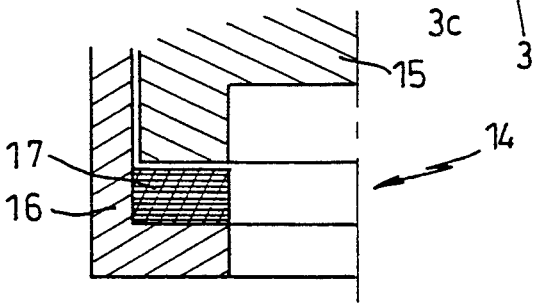
FIG.6

UNREPLACEABLE RECEPTACLE CLOSURE SYSTEM

FIELD OF THE INVENTION

The present invention relates to a receptacle closure system that is unreplaceable, i.e. to a closure member that can be secured only once to the threaded neck of a receptacle for the purpose of closing it, e.g. in the form of a cap, or in the form of a ring suitable for supporting a dispenser system for dispensing a fluid contained in the receptacle (e.g. a pump), or else in any other form.

It is known to provide receptacle closures with means for indicating whether the receptacle have been opened, in particular for the purpose of guaranteeing to the customer that the contents of the receptacle have not been changed or partially emptied prior to purchase.

BACKGROUND OF THE INVENTION

For example, it is common practice to close bottles of liquids by means of a cap that is connected via breakable solid bridges to a ring that is secured to the neck of the bottle. Commonly the cap and the ring are made of metal if the bottle is made of glass, or of polyethylene if the bottle is made of PVC. Nevertheless, such closure systems present problems when recycling bottles. The ring which is secured to the bottle is generally made of a material that is different from that from which the bottle is made and which cannot be recycled under the same conditions as the bottle. The ring must therefore be removed from the bottle prior to recycling, and that increases the cost of recycling.

It is also well known that glass bottles can be closed by means of a crimped metal capsule or "bottle-top", thereby guaranteeing that the bottle has not been opened. However it is then necessary to use a bottle opener in order to open the bottle, and that is not always practical.

OBJECTS AND SUMMARY OF THE INVENTION

An object of the invention is to provide a system for closing a receptacle that guarantees that the receptacle has not been opened, that can be opened without using a receptacle-opening tool, and that is completely removed from the receptacle on being opened so as to facilitate subsequent recycling of the receptacle.

The invention therefore provides a closure system for a receptacle having a neck in which an opening is formed and provided with outwardly projecting external threads each extending between a first end further from the opening and a second end closer to the opening, the system comprising a closure member or cap having a side wall that surrounds the neck and that fits substantially snugly over the shape of the external threads of said neck, said cap being made of a material that is elastically deformable, wherein at least some of the threads of the neck are spaced apart in pairs by a circumferential distance around the neck that decreases progressively between the first and second ends of the threads. The cap can then be unscrewed manually, disengagement of the second ends of the threads being allowed by resilient deformation of the inside of the side wall of the cap, due to the wedging effect. However, the user cannot reclose the cap after opening it, since the cap material returns elastically to its shape prior to unscrewing. In addition, the method of assembly provided by the present invention is more reliable than a conventional method since that can always give rise to involuntary unscrewing.

In a particular embodiment, the external threads are wedge-shaped, their second ends being wider than their first ends.

In another embodiment, the external threads are distributed in two groups of threads comprising a first group of threads forming a first angle relative to a direction of an axis of revolution of the neck, and a second group of threads forming a second angle relative to said direction, said second angle being different from the first angle and the external threads of the two groups being distributed in alternation around the neck.

In one version the neck of the receptacle is made of a hard material, the cap is made of metal, and its side wall is crimped onto the neck in a region that does not extend axially substantially beyond the first ends of the threads going away from the opening of the neck.

In another version the neck of the receptacle is made of a hard material, the cap is made of a flexible plastics material, and its side wall includes inwardly directed projections that overlie the external threads of the neck and that do not extend axially substantially beyond the first ends of the threads going away from the opening of the neck. The cap is engaged by force onto the neck by crushing said internal projections, which partially return to their initial shape after screwing by force, constituting a substantially snug fit around the shape of the threads. Said internal relief may be in the form of axial ribs. The force-fit may be mutual engagement followed by screwing, or it may be screwing alone.

Advantageously, the threads have the barbed or "artillery" profile that makes it difficult to pull the cap off, and that facilitates penetration of the threads into the inside relief of cap if the cap is made of flexible plastic that is force-fitted by screwing or by thrusting.

BRIEF DESCRIPTION OF THE DRAWING

Other characteristics and advantages of the invention appear from the following detailed description of various embodiments of the invention given by way of non-limiting example and described with reference to the accompanying drawing.

In the drawing:

FIG. 1 is an elevation view of the neck of a receptacle belonging to a closure system constituting one embodiment of the present invention;

FIG. 2 is a detail section view of the neck of FIG. 1, on line II—II of FIG. A;

FIG. 3 is an axial section view through a cap of plastics material for fixing to the FIG. 1 receptacle neck;

FIG. 4 is an axial section view through the closure system constituting the FIG. 3 cap when fixed to the neck of FIG. 1;

FIG. 5 is an axial section view through a variant of the FIG. 3 system, comprising a crimped metal cap, and shown together with the tool used for crimping;

FIG. 6 is an axial section view through the crimping tool shown in FIG. 5, but in its rest position; and FIG. 7 is an elevation view of the neck of a receptacle suitable for use in another variant of the invention.

DETAILED DESCRIPTION OF THE PREFERRED EMBODIMENTS

In FIG. 1, a receptacle 1 (that may be made of glass, for example) has a neck 4 about an axis of revolution 4*a* and defining an opening 10 that communicates with the inside of the receptacle 1. The neck 4 includes outwardly-projecting external threads 5, each extending from a narrow end 5*a* that is axially remote from the opening 10 and a large end 5*b* that is axially closer to the opening 10. In this way, the threads 5 are mutually spaced apart circumferentially by a distance d that decreases from between the narrow ends 5*a* of the threads to between the wide ends 5*b* thereof.

As shown in FIG. 2, the threads 5 in this example have a barbed or "artillery" profile, that is to say they have one face 5*c* that slopes towards the opening 1*a*, and another face 5*d* that is substantially radial and that faces away from the opening 10.

The neck of the FIG. 1 receptacle is closed by means of a closure member or cap 2 made of plastics material and shown in FIG. 3. The cap 2 has a circularly cylindrical side wall 2*a* for surrounding the neck 4 of the receptacle and that extends axially between an end wall 2*b* and a free end 2*c*. The end wall 2*b* shown in FIG. 3 is solid, however it should be observed that the end wall 2*b* could optionally include an opening in which an apparatus could be mounted for dispensing a substance contained in the receptacle, e.g. a pump.

The side wall 2*a* of the cap also includes internal ribs 11 that extend axially over a certain distance from the end wall 2*b* of the cap.

In order to mount the cap 2 on the neck 4 of the receptacle, the cap 2 is forced onto the neck 4 and is then screwed while applying force, using mechanical means (an assembly machine). The forced engagement is facilitated by the "artillery" profile of the threads 5 on the neck. The forced engagement step could be omitted, in which case the cap would be engaged on the neck 4 solely by the forced screwing motion. The forced screwing serves to tap the ribs 11 by causing them to be crushed by the threads 5, as shown in FIG. 4. During such forced screwing, the wide ends 5*b* of the threads 5 are the first to penetrate into the rib-forming material, after which the remainders of the threads penetrate entirely into the ribs 11 by following the paths formed by the wide ends 5*b*. Nevertheless, since the cap is made of a flexible plastics material, e.g. low density polyethylene, the ribs 11 return in part to their initial shape after they have been crushed by the wide ends 5*b*, such that after assembly, said ribs 11 substantially constitute a snug fit over the threads 5, even including the narrowest ends 5*a* of said threads 5. As can be seen in FIG. 4, the ribs 11 extend axially from the end wall 2*b* to the narrow ends 5*a* of the threads 5, but they do not extend significantly beyond said ends 5*a* going away from the opening 10. Optionally, the ribs 11 could even come to an end at an intermediate position along the threads 5.

As shown in FIG. 4, it is optionally possible for a flat sealing gasket 13 to be interposed between the neck 4 of the receptacle and the end wall 2*b* of the cap 2.

When a user seeks to open the receptacle 1, the cap 2 must be unscrewed. This unscrewing causes a portion of the ribs 11 to be crushed again, because the crushed portions of the ribs 11 that fitted substantially over the shape of the narrow ends 5*a* of the threads must pass back over the large ends 5*b* of the threads. However, this crushing is done without too much difficulty because of the wedge shape of the threads 5 and because the wedge angle $\alpha$ is small. However, after the cap 2 has been fully unscrewed, the ribs 11 return at least in part to their previous shape by elasticity, at least in those portions thereof that were not subjected to permanent deformation by being fitted over the shape of the threads 5 for a long period of time. Thus, after a cap 2 of plastics material has been unscrewed, the user cannot screw it back on since that would require the wide ends 5*b* of the threads 5 to be passed through the narrow crushed zones that corresponded to the narrow ends 5*a* of the threads when the capsule was in place on the neck.

FIG. 5 shows a variant of the FIG. 4 system in which the plastics cap 2 is replaced by a metal cap 3 that similarly has a side wall 3*a* extending axially from an end wall 3*b* to a free end 3*c*. The neck 4 of the receptacle may be identical to that of FIG. 1, and a sealing disk 13 may be interposed between the neck 4 of the receptacle and the end wall 3*b* of the cap. In this variant, the side wall 3*a* of the metal cap 3 is crimped onto the threads 5 in a region that does not extend axially substantially beyond the first end 5*a* of the threads going away from the opening 10 of the neck 4. In the example shown, this region extends solely over the threads 5. Optionally, the region could extend only over a portion of the threads 5, and it could also extend up to the end wall 3*b* of the cap 3. The cap may be crimped by means of a known crimping clamp 14 shown in its rest position in FIG. 6. In outline, the clamp 14 has two annular jaws 15 and 16 disposed axially on either side of an annular part 17 made of elastomer. At rest, as shown in FIG. 6, the two jaws 15 and 16 and the annular part 17 made of elastomer have substantially the same inside diameter. When the two jaws 15 and 16 clamp the annular part made of elastomer between them, as shown in FIG. 5, the part 17 is deformed radially inwards so as to clamp the side wall 3*a* of the cap onto the neck 4 of the receptacle, by fitting closely over the outside shape of the side wall 3*a* of the cap in the crimping zone.

FIG. 7 shows a variant shape for the threads on the neck 4 of the receptacle, and usable with the types of cap described above. The neck 4 in FIG. 7 has outwardly projecting external threads 6 and 7 making up two groups. A first group comprises threads 6 at a first angle $\alpha_1$ relative to the axis of revolution of the neck 4, and a second group comprises the threads 7 which are at a second angle $\alpha_2$ relative to said direction of the axis of revolution of the neck, where $\alpha_2$ is slightly different from the first angle $\alpha_1$. The threads in the two groups alternate around the neck such that the configuration of FIG. 7 is equivalent to the wedge-shaped threads 5 of FIG. 1.

We claim:

1. A closure system for a receptacle comprising: a closure member, and a receptacle neck in which an opening is formed and provided with outwardly projecting external threads each extending between a first end further from the opening and a second end closer to the opening, the closure member having a side wall that surrounds the neck and that fits substantially snugly over the shape of the external threads of said neck, said closure member being made of a material that is elastically deformable, wherein at least some of the threads of the neck are spaced apart in pairs by a circumferential distance around the neck that decreases progressively between the first and second ends of the threads.

2. A system according to claim 1, in which the external threads are wedge-shaped, the second ends being wider than the first ends.

3. A system according to claim 1, in which the external threads are distributed in two groups of threads comprising a first group of threads forming a first angle relative to an axis of revolution of the neck, and a second group of threads forming a second angle relative to said axis of revolution, said second angle being different from the first angle and the external threads of the two groups being distributed alternately around the neck.

4. A system according to claim 1, in which the neck of the receptacle is made of a hard material, the closure member is made of metal, and the side wall of the closure member is crimped onto the neck in a region that axially encompasses the first ends of the threads.

5. A system according to claim 1, in which the threads have a barbed profile.

6. A system according to claim 1, in which the neck of the receptacle is made of a hard material, the closure member is made of a flexible plastics material, and the side wall of the closure member includes inwardly directed projections that overlie the external threads of the neck and that terminate axially proximate the first ends of the threads, wherein the closure member is engaged by force onto the neck by crushing said internal projections thereof, said internal projections thereafter partially elastically returning to an initial shape to substantially snugly fit around the threads.

7. A system according to claim 6, in which said internal projections are axial ribs.

* * * * *